United States Patent [19]

Phillips

[11] Patent Number: 4,543,697

[45] Date of Patent: Oct. 1, 1985

[54] LOW FRICTION DRAFTING SYSTEM FOR YARNS

[75] Inventor: Bobby M. Phillips, Kingsport, Tenn.

[73] Assignee: Eastman Kodak Company, Rochester, N.Y.

[21] Appl. No.: 597,882

[22] Filed: Apr. 9, 1984

[51] Int. Cl.[4] ..... D02J 1/22

[52] U.S. Cl. ..... 28/246; 57/310; 264/290.7

[58] Field of Search ..... 28/245, 246; 57/310; 264/290.5, 290.7

[56] References Cited

U.S. PATENT DOCUMENTS 3,471,608 10/1969 Schippers ..... 264/290.5
4,461,740 7/1984 Koschinek et al. ..... 264/290.5 X

FOREIGN PATENT DOCUMENTS 1348694 12/1963 France ..... 264/290.5
447464 11/1967 Switzerland ..... 264/290.5

*Primary Examiner*—Robert R. Mackey
*Attorney, Agent, or Firm*—Malcolm G. Dunn; William P. Heath, Jr.

[57] ABSTRACT

Low friction drafting system for yarn and having in sequence a driven feed roll, a low friction freely rotatable hot roll for preheating the yarn, a low friction freely rotatable hot roll for thermally stabilizing the yarn, a driven output roll, with tension automatically transferring upstream of the preheater roll to preheat the yarn and with the two heated rolls being driven by engagement with the yarn; the thermally stabilizing roll operates at a greater speed than the preheater roll and drafting of the yarn occurs between the two freely rotatable hot rolls.

4 Claims, 4 Drawing Figures

LOW FRICTION DRAFTING SYSTEM FOR YARNS

DESCRIPTION

1. Technical Field

The present invention is directed to a low friction drafting system for yarns generally used for textile yarns and is particularly directed to a system for drafting yarns, such as polyester yarns, at speeds greater than 300 meters per minute up to 1500 meters per minute and greater.

2. Background

There is considerable prior art in the drafting of yarns, and particularly for polyester yarns. U.S. Pat. No. 3,539,680 discloses one system where speeds disclosed are around 600 meters per minute to 1500 meters per minute; however, relatively speaking, this is a very expensive system requiring equipment and maintenance that can be omitted with the system that I propose herein.

Pretensioning yarn in a drafting system before the yarn contacts any heated device, whether such device be a fixed pin, a rotating roll, a stationary contact heater or other type of device, is an important contribution toward obtaining a uniformly dyeable and defectfree yarn. U.S. Pat. No. 3,539,680 mentioned above recognizes the importance of such pretensioning so as to minimize occurrence of "fluffs" and dyeing unevenness (Col. 4, lines 43–47). The patent discusses an arrangement for obtaining such pretension by providing the combination of a nip roller and a delivery roller, and employing a ratio of peripheral speeds of the delivery roller to the heated feed roller within the range of 1:1.001–1:1.030. Thus the patent discloses establishing a pretension zone which is designed to draw the yarn slightly, as indicated by the given ratio range, in order to achieve the required pretensioning. The patent indicates alternatively that a thread brake or guide may be used if it can impart uniform and predetermined tension.

Other types of drafting systems employ heated pins, heated plates, and heated plates with separator rolls, all of which are well known. The quality of the yarn produced on these systems, however, has been found to be generally poorer due to the high level of broken filaments and poorer dye uniformity than that produced on a system such as represented by the above-mentioned U.S. Pat. No. 3,539,680, and the problems of broken filaments and poor dye uniformity have been found to increase as the speed is increased. Broken filaments tend to cause defects, which cause waste and loss of time.

An object of my invention is to provide a low friction drafting system which provides automatic pretensioning of the yarn before the yarn contacts any heated device and without employing the usual structures upstream from such heated device to provide such pretensioning.

Also, an objective of my invention is to provide in the low friction drafting system a low friction thermal stabilization device.

Another object of my invention is to provide a low maintenance drafting system.

A further object of my invention is to provide a drafting system which will operate satisfactorily from a mechanical quality and dye uniformity standpoint, at speeds up to 1500 meters per minute and greater.

Still another object is to provide a less expensive drafting system for providing textile yarns of equivalent quality to those made by the process disclosed in U.S. Pat. No. 3,539,680.

A still further object is to provide a compact drafting system taking up less space than other drafting systems in the prior art.

In an alternate embodiment of the invention, an object is to provide controlled relaxation of the yarn to make a more thermally stable yarn.

DISCLOSURE OF INVENTION

In accordance with the present invention, I provide a low friction system for drafting and stabilizing yarn. The system has a driven feed roll for feeding the yarn at a predetermined speed and a driven output roll for forwarding the yarn at a predetermined speed greater than that of the driven feed roll. The system includes a first low friction freely rotatable hot roll, the surface of which is heated to a predetermined temperature for preheating the yarn with the roll being located between the driven feed roll and the driven output roll. A low friction separator roll is spaced adjacent to the first freely rotatable hot roll and the yarn is wrapped a plurality of times around the first freely rotatable hot roll and the separator roll. The system also includes a second low friction freely rotatable hot roll, the surface of which is heated to a predetermined temperature greater than that of the first freely rotatable hot roll for thermally stabilizing the yarn with the roll being located between the first freely rotatable hot roll and the driven output roll. A second low friction separator roll is spaced adjacent to the second freely rotatable hot roll and the yarn is wrapped a plurality of times around the second freely rotatable hot roll and the second separator roll. The driven feed roll and the first freely rotatable hot roll operate at essentially the same surface speed with the first freely rotatable hot roll being driven by engagement with the yarn. The second freely rotatable hot roll and the driven output roll operate at essentially the same surface speed but greater than that of the first freely rotatable hot roll with the second freely rotatable hot roll being driven by engagement with the yarn. In this system, sufficient yarn tension is automatically transferred upstream of the first freely rotatable hot roll to pretension the yarn before it contacts the first freely rotatable hot roll and drafting of the yarn takes place between the first freely rotatable hot roll and the second freely rotatable hot roll.

In this low friction drafting system, greater than 60 percent of yarn draw tension is transferred upstream of the first low friction freely rotatable hot roll before the yarn contacts the first freely rotatable hot roll.

Also in this low friction drafting system, the first and second low friction freely rotatable hot rolls may be supported for rotation on air bearings or on ball bearings.

When the yarn being processed on the low friction drafting system is a polyester yarn, the predetermined temperature for the surface of the first low friction freely rotatable hot roll is about 80° C. to about 120° C. and the predetermined temperature for the surface of the second low friction freely rotatable hot roll is about 120° C. to about 220° C.

The second low friction freely rotatable hot roll may be what is called a "stepped roll", having at least two steps or different diameters wherein the ratio of the greater circumference of the first step to the smaller circumference of the second step is from about 1 to about 1.1 so as to provide a controlled relaxation of the yarn from about one (1) to about ten (10) percent.

BRIEF DESCRIPTION OF THE DRAWINGS

The details of my invention will be described in connection with the accompanying drawings, in which.

BEST MODE FOR CARRYING OUT THE INVENTION

Figure 1:
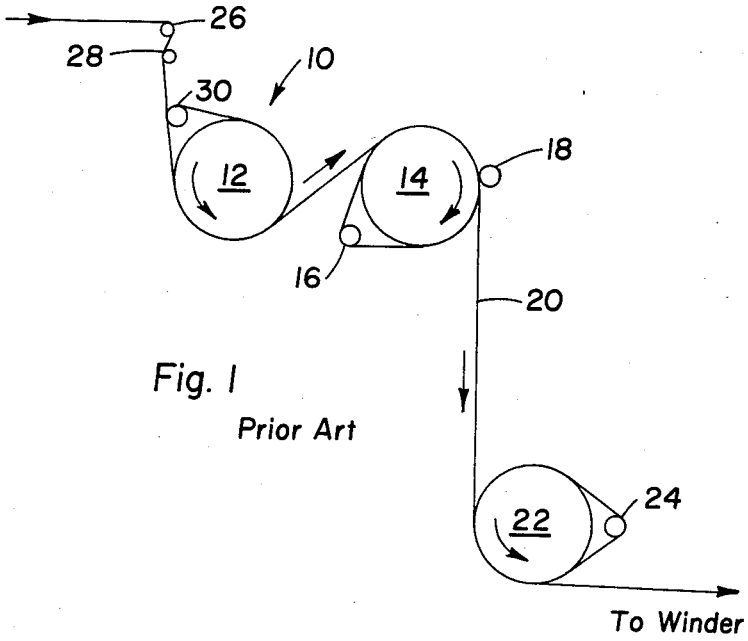
Fig. 1 Prior Art
FIG. 1 is a schematic elevational view of a prior art drafting system employing a pinch roll such as that disclosed in the above-mentioned U.S. Pat. No. 3,539,680.

FIG. 1 represents a prior art drafting system 10 such as disclosed in U.S. Pat. No. 3,539,680 in which a pretension zone for the yarn being processed is established between a nonheated godet roll 12 and a heated godet roll 14 and its separator roll 16, and a pinch roll 18 bearing against the heated godet roll 14 serves to minimize variability of the yarn drafting by preventing the drafting of the yarn 20 from extending upstream of the location of the pinch roll 18. The godet roll 22 and its separator roll 24 serve as an output roll arrangement for forwarding the yarn to a winder (not shown). Guides for the yarn are shown at 26 and 28; 30 designates the separator roll for the nonheated godet roll 12.

Figure 2:
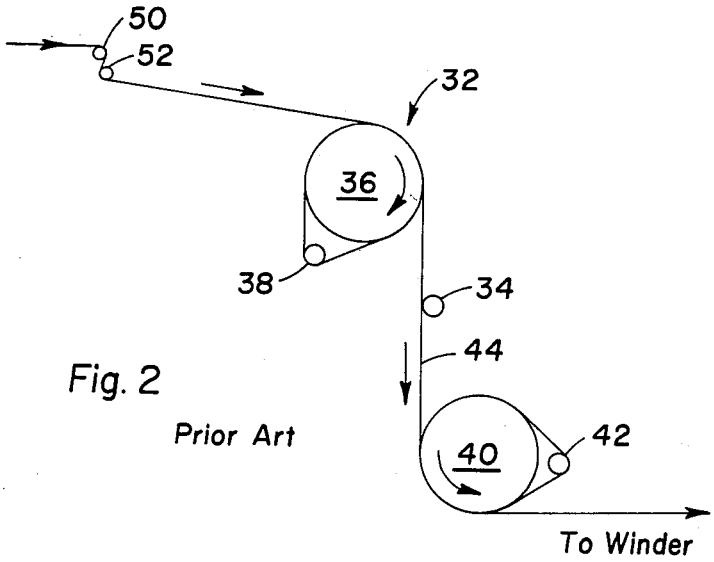
Fig. 2 Prior Art
FIG. 2 is a schematic elevational view of a prior art drafting system employing a heated pin.

FIG. 2 represents a prior art drafting system 32 which employs a heated stationary pin 34 between a nonheated godet roll 36 and its separator roll 38 and a nonheated godet roll 40 and its separator roll 42, the latter two serving as an output roll arrangement for forwarding the yarn 44 to a winder (not shown). Yarn guides 50 and 52 are shown located upstream of the first-mentioned nonheated godet roll 36.

Figure 3:
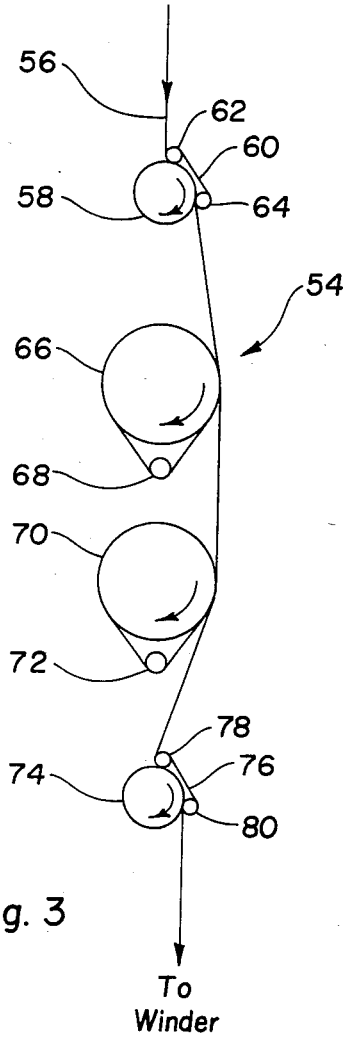
FIG. 3 is a schematic elevational view of the drafting system of the present invention employing a first low friction freely rotatable hot roll for preheating the yarn and a second low friction freely rotatable hot roll for thermally stabilizing the yarn.

In FIG. 3, which represents my proposed low friction drafting system 54 of the present invention, the yarn 56 is shown being fed into the system by a driven feed roll 58. The yarn may be held in engagement with the feed roll by a casablanca (an endless rubber belt 60 supported by two idler rolls 62,64). The yarn then advances to a first low friction freely rotatable hot roll 66 which is heated to a predetermined temperature, such as about 80° to 120° C., for preheating the yarn, and its low friction separator roll 68, which is spaced adjacent to the first freely-rotatable hot roll. The yarn is wrapped a plurality of times around the heated roll 66 and its separator roll 68 to insure adequate contact time with the yarn for heating of the yarn.

The yarn 56 advances from the first freely rotatable roll 66 and its low friction separator roll 68 to the second low friction freely rotatable hot roll 70 which is heated to a predetermined temperature such as about 120° to 220° C., a greater temperature than that of the first freely rotatable hot roll 66 for thermally stabilizing the yarn, and its low friction separator roll 72, which is spaced adjacent to the second freely rotatable hot roll. The yarn is again wrapped a plurality of times around the heated roll 70 and its low friction separator roll 72 to insure adequate contact time with the yarn for heating of the yarn.

The yarn 56 advances from the second freely rotatable hot roll 70 and its low friction separator roll 72 to the driven output roll 74, which forwards the yarn to a winder (not shown) at a predetermined speed greater than that of the driven feed roll 58. The yarn may be held in engagement with the driven output roll 74 by a casablanca (an endless rubber belt 76 supported by two idler rolls 78,80). It is quite surprising to me that drafting of the yarn actually takes place between the first and second freely rotatable hot rolls.

The low friction freely rotatable hot rolls 66 and 70 are preferably supported for rotation on an air bearing. For instance, U.S. Pat. No. 4,053,277 discloses a heated air bearing roll that in principle would be suitable for practice of the present invention. Although there is no disclosure in the patent of where the thermocouple would be positioned to assure predetermined surface temperatures of the rolls, I would suggest employing a thermocouple internally of the roll with its probe being positioned just beneath the surface of the roll such as disclosed in U.S. Pat. No. 3,879,594 or U.S. Pat. No. 3,296,418 for example. Air bearings or rolls supported for rotation by air bearings are also shown in U.S. Pat. Nos. 4,013,326, 3,753,517, and 3,560,062. The hot rolls also be supported for rotation by ball bearings, which are conventional in the art, such as shown in U.S. Pat. No. 3,296,418. The design of these two rolls, however, must be of very low friction. The two separator rolls 68,72 may also be supported on air bearings or ball bearings to minimize rolling friction.

A significant and surprising feature of the low friction-free rotation of these two rolls is that the first freely rotatable hot roll 66 will operate at essentially the same surface speed of the driven feed roll 58 with the roll 66 being driven by engagement with the yarn 56, and that the second freely rotatable hot roll 70 will operate at essentially the same surface speed of the driven output roll 74 with the roll 70 being driven by engagement with the yarn. As a consequence of such low friction, sufficient yarn tension automatically will be transferred upstream of the first freely rotatable hot roll 66 to pretension the yarn before it contacts the hot roll 66, and, as mentioned previously, another consequence is that drafting of the yarn will surprisingly take place between the first and second freely rotatable hot rolls.

The amount of tension transferred upstream of the first freely rotatable hot roll 66 will be greater than 60 percent.

It is significant to note that the feed system does not have to be godet rolls, as is often true in the prior art, but can be of any of the lesser-costing devices used on false twist texturing machines (i.e., rubber cots on shafts, or casablancas as shown).

In the system as disclosed, the sequential actions of feeding the yarn, pretensioning it before it touches a heated surface, preheating the yarn, drafting the yarn, thermally stabilizing the yarn, and outputting the yarn occur naturally. The only independent variables are (1) draw ratio, (2) speed, (3) temperature, and (4) frictional resistance. It is quite surprising to me that those functions occur sequentially in this arrangement.

Another advantage of the described low friction drafting system is that it will take up much smaller space in a yarn processing apparatus. For instance, the heated rolls may be about 70 millimeters in diameter with the separation between the two rolls being about one-third of a meter. The distance between the driven feed roll 58 and the driven output roll 74 may be about 50 to 75 centimeters.

Table I shows typical processing conditions and corresponding drawn yarn quality. A polyester (from polyethylene terephthalate polymer) POY (partially oriented yarn) was used to evaluate the drafting system. See U.S. Pat. No. 4,245,001 for a description of the polymer, spinneret, and spinning conditions for making the POY.

TABLE I

Summary of Processing Conditions and Yarn Properties of Poly(ethylene terephthalate) Yarn

| Example Number | Preheat Temp. | Stabilizing Temp. | Overall Draw Ratio | Tension in grams above heated rolls | Tension in grams between heated rolls | Tension in grams below heated rolls | Speed Ratio of heated rolls | Yarn Quality BF* | Yarn Quality Dye |
|---|---|---|---|---|---|---|---|---|---|
| 1 | 90° C. | 120° C. | 1.60 | 45 | 58 | 62 | 1.51 | Excellent | Excellent |
| 2 | 100° C. | 120° C. | 1.60 | 36 | 52 | 57 | 1.56 | Excellent | Excellent |
| 3 | 110° C. | 140° C. | 1.60 | 44 | 50 | 55 | 1.57 | Excellent | Excellent |
| 4 | 120° C. | 140° C. | 1.60 | 50 | 58 | 63 | 1.57 | Excellent | Excellent |
| 5 | 120° C. | 160° C. | 1.60 | 44 | 48 | 65 | 1.53 | Excellent | Excellent |
| 6 | 120° C. | 180° C. | 1.60 | 42 | 48 | 65 | 1.53 | Excellent | Excellent |

Figure 4:
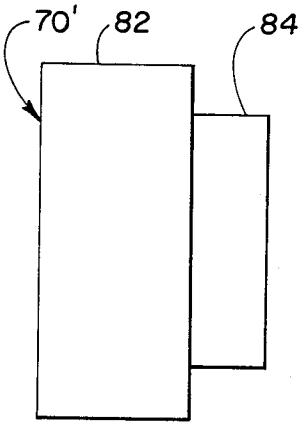
FIG. 4 is a front elevational view of a stepped heated roll.

Rolls - 70 mm diameter
Preheat Roll - 8 wraps
Stabilizing Roll - 10 wraps
POY - 120/20 filament yarn
*BF = broken filaments FIG. 4 discloses an alternate embodiment of a second low friction freely rotatable hot roll designated 70', which is a stepped roll or a roll having at least two steps. The two steps refer to a first diameter 82 and a smaller second diameter 84. The ratio of the greater circumference (first step) to the smaller circumference (second step) is from about 1 to about 1.1 so as to provide a controlled relaxation of the yarn from about one (1) to about ten (10) percent. For instance, for a 1 percent relaxation, the diameter of the second step of the roll would be reduced from 70 mm to about 69.3 mm; for a 3 percent relaxation, the diameter of the second step would be about 67.9 mm; for a 5 percent relaxation, the diameter of the second step would be about 66.5 mm; for a 7 percent relaxation, the diameter would be about 65.1 mm; and for a 10 percent relaxation, the diameter would be about 63.0 mm. Preferably, about 5 percent controlled relaxation is a desired objective.

The controlled relaxation of the yarn will enable a polyester yarn, for example, to have a lower boiling water shrinkage (b.w.s.), which makes a more thermally stable yarn.

The invention has been described in detail with particular reference to preferred embodiments thereof, but it will be understood that variations and modifications can be effected within the spirit and scope of the invention.

I claim:

1. A low friction drafting system for yarn and comprising:

a driven feed means for feeding said yarn at a predetermined speed;

a driven output means for forwarding said yarn at a predetermined speed greater than that of said driven feed means;

a first low friction freely rotatable hot roll, the surface of which is heated to a predetermined temperature for preheating said yarn; said first freely rotatable hot roll being located between said driven feed means and said driven output means;

a low friction separator roll spaced adjacent to said first freely rotatable hot roll and wherein said yarn is wrapped a plurality of times around said first freely rotatable hot roll and said separator roll;

a second low friction freely rotatable hot roll, the surface of which is heated to a predetermined temperature greater than that of said first freely rotatable hot roll for thermally stabilizing the yarn; said second freely rotatable roll being located between said first freely rotatable hot roll and said driven output means;

a low friction second separator roll spaced adjacent to said second freely rotatable hot roll and wherein said yarn is wrapped a plurality of times around said second freely rotatable hot roll and said second separator roll;

said driven feed means and said first freely rotatable hot roll operating at essentially the same surface speed with said first freely rotatable hot roll being driven by engagement with the yarn, and said second freely rotatable hot roll and said driven output means operating at essentially the same surface speed but greater than that of said first freely rotatable hot roll with said second freely rotatable hot roll being driven by engagement with the yarn; and whereby sufficient yarn tension automatically is transferred upstream of said first freely rotatable hot roll to pretension said yarn before it contacts said first freely rotatable hot roll and drafting of said yarn takes place between said first freely rotatable hot roll and said second freely rotatable hot roll.

2. A low friction drafting system as defined in claim 1 wherein said first and second low friction freely rotatable hot rolls are supported for rotation on an air bearing.

3. A low friction drafting system as defined in claim 1 wherein said first and second low friction freely rotatable hot rolls are supported for rotation on ball bearing.

4. A low friction drafting system as defined in claim 1 wherein said second low friction freely rotatable hot roll is at least a two-step roll wherein the ratio of the greater circumference of the first step to the smaller circumference of the second step is from about 1 to about 1.1 so as to provide a controlled relaxation of the yarn from about one (1) to about ten (10) percent.

* * * * *